United States Patent [19]

Kainz

[11] 4,288,074

[45] Sep. 8, 1981

[54] APPARATUS FOR CONVEYING TENNIS BALLS TO A BALL-THROWING MACHINE

[76] Inventor: Norbert Kainz, Pyrkergasse 21, Vienna, Austria

[21] Appl. No.: 168,337

[22] Filed: Jul. 14, 1980

[51] Int. Cl.[3] ..... A63B 61/00

[52] U.S. Cl. ..... 273/29 A; 124/51A; 406/81; 406/154

[58] Field of Search ..... 273/29 R, 29 A, 47–49, 273/26 D, 30; 124/56, 51 R, 51 A, 82, 57, 41 R, 201, 202; 222/290; 198/725; 406/81, 154, 180

[56] References Cited

U.S. PATENT DOCUMENTS

| | | | |
|---|---|---|---|
| 1,364,404 | 1/1921 | Nygreen | 406/180 |
| 3,306,613 | 2/1967 | Mainers | 273/26 D |
| 3,911,888 | 10/1975 | Horvet | 273/30 |
| 3,989,246 | 11/1976 | Brown | 124/51 A |
| 4,002,334 | 1/1977 | Beaver | 273/30 |
| 4,021,037 | 5/1977 | Torbet | 273/30 |
| 4,027,646 | 8/1977 | Sweeton | 124/56 |
| 4,074,905 | 2/1978 | High | 124/51 R |
| 4,077,386 | 3/1978 | Berliner | 273/30 |
| 4,207,857 | 6/1980 | Balka, Jr. | 124/56 |
| 4,243,288 | 11/1980 | Albrecht | 198/725 |

FOREIGN PATENT DOCUMENTS

| | | | |
|---|---|---|---|
| 2334849 | 10/1975 | Fed. Rep. of Germany | 273/29 A |
| 2532236 | 3/1976 | Fed. Rep. of Germany | 273/30 |

*Primary Examiner*—Richard C. Pinkham
*Assistant Examiner*—T. Brown
*Attorney, Agent, or Firm*—Ernest F. Marmorek

[57] ABSTRACT

The apparatus comprises a wall (7) from which tennis balls (13) fall into a chute (8) fitted with lateral ramp sections (15, 16). The balls are carried along the chute by an endless conveyor (14) fitted with ball-entrainment (14). The balls are guided down a sloping section (18) at an end of the chute (14) by guides (19) and are then sucked along a flexible tube (11) to a rigid conduit (26). The conduit (26) has an end (21) of enlarged section fitted with a hinged closure flap (22) and an underpressure generating device (23).

6 Claims, 4 Drawing Figures

APPARATUS FOR CONVEYING TENNIS BALLS TO A BALL-THROWING MACHINE

The invention relates to apparatus for conveying tennis balls to a ball-throwing machine, the apparatus comprising a collecting chute; a rebound-deadening wall projecting upwards from one side of the collecting chute; a flexible tube having first and second ends and attached at the first end to the collecting chute at a withdrawal point thereof; a rigid conduit having first and second ends and attached at the first end thereof to the second end of the flexible tube; a hinged closure at the second end of the rigid chute; and a device for generating underpressure connected laterally to the rigid conduit, whereby the underpressure in the rigid conduit normally holds the hinged closure in a closed position and tennis balls passing from the collecting chute into the flexible tube are conveyed therealong by the underpressure to the rigid conduit where a ball is capable of opening the hinged closure and thereby passing out of the rigid conduit to the ball-throwing machine. Such apparatus in hereinafter referred to as of the kind described.

Conventionally, ball-throwing machines have to be filled with tennis balls, which are subsequently thrown in succession towards the tennis player in training. Ball-throwing machines of this kind can be installed on any tennis court, in which case the site can be selected at will. For practising with this kind of machine a large number of tennis balls are required, and the balls have to be collected up and the ball-throwing machine refilled.

Apparatus of the kind described is disclosed in U.S. Pat. No. 4,021,037. That apparatus is equipped with a device for returning the played balls to the ball-throwing machine. Disadvantages, however, are that the ball-throwing machine and the ball-conveyor device form one operating unit and cannot be detached from one another, that the ball-reception aperture of the ball-conveyor device can be easily obstructed by two tennis balls simultaneously reaching the aperture, and that balls may roll under a V-shaped ball-collecting ramp and are thus not collected. Furthermore, a tennis training apparatus of a different type is known from West German Offenlegungsschrift No. 23 34 849, in which the tennis balls are collected in a collecting chute, which is kept low in relation to the playing surface, and are conveyed towards a ball-throwing machine, which is movable only at he edge of the court, parallel to the net. Finally, an extremely complicated tennis training apparatus is known from West German Offenlegungsschrift No. 24 56 997, but this can only be used on a tennis court, specially designed for the apparatus.

It is an object of the invention to provide an apparatus of the kind described which ensures trouble-free conveyance to the ball-throwing machine of all balls passing into the collecting chute, and which can be readily detached from the ball-throwing machine or attached to any ball-throwing machines whatever.

This object is achieved, according to the invention by an apparatus of the kind described which has the following features:

(a) the collecting chute is provided with an endless conveyor element passing around two sheaves and provided with spaced ball-entrainment means, a run of the conveyor element being spaced above a bottom of the collecting chute by a distance so as to engage balls in the chute;

(b) the collecting chute has a downwardly sloping section only at one end adjacent to the withdrawal point and is provided above the downwardly sloping section with at least two guide members adapted to deflect the balls downwards, the run of the conveyor element passing between the guide members;

(c) a double section ramp is fitted to the side of the chute remote from the one side from which the rebound-deadening wall projects upwards, a first section of the ramp rising upwards away from the collecting chute and a second section of said ramp descending from the first section in use to the level of a tennis court on which the chute stands; and (d) the flexible tube is freely movable and extends to a ball-dispensing unit incorporating the device for generating underpressure and the rigid conduit and adapted to be fitted to the ball-throwing machine, the device for generating underpressure being attached to the upper wall of an obliquely downwardly sloping end piece of the rigid conduit, the end piece being provided at its lower end with the hinged closure and having a cross section greater than an upstream portion of the rigid conduit.

Apparatus of this construction has the advantage that it can be installed on any tennis court in a simple manner and at low expense. The ball conveying apparatus is detachable from the ball-throwing machine and freely movable and can be attached to any ball-throwing machine, which can be sited anywhere on the court. For the purpose, it is only necessary to fix the ball-dispensing unit, which is attached to the free end of the flexible tube and to which the device for generating underpressure is attached, to a conventional ball-throwing machine.

Since the collecting chute contains a conveyor element, it can be essentially horizontally arranged. The conveyor element, which can take the form of a string such as a cord or the like and the ball-entrainment means of which can be projections such as knots in, or buttons or the like on, the string, makes continuous and orderly conveyance of the balls possible.

Preferably, the first ramp section is detachably pivotally connected to the collecting chute and the second ramp section is detachably pivotally connected to the first ramp section. In this way, the catchment range of the collecting chute is considerably increased, without the latter becoming unwieldy. Owing to this articulated joining of the ramp sections and the detachable fixing of the ramp to the collecting chute, the apparatus can be easily transported, so that any normal tennis court, on which a ball-throwing machine is available, can be transformed into an automatic training unit with little manipulation.

Further features of the invention will be apparent from the accompanying drawings which show one example of the apparatus according to the invention in use with a tennis court. In the drawings.

Figure 1:
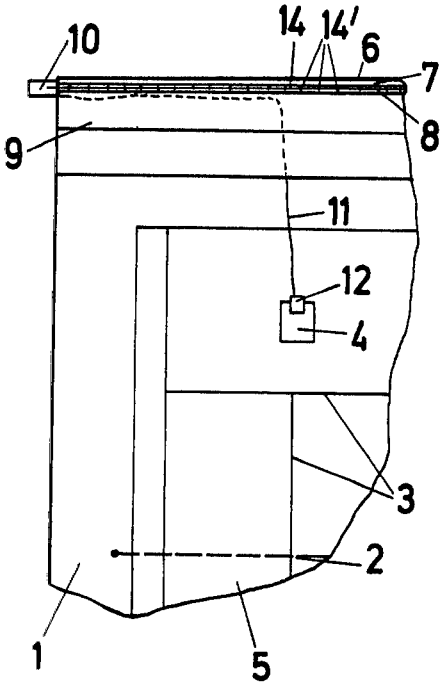
FIG. 1 shows a corner of the tennis court with part of the apparatus in plan.

FIG. 1 shows a corner of a tennis court on a playing surface 1, and provided with a net 2 and lines 3. A ball-throwing machine 4 is positioned on one side of the net to throw tennis-balls 13 across the net 2 to the other side 5, from where the practising player returns it again across the net 2. The tennis balls 13, struck across the net 2 by the player, have now to be conveyed back to the ball-throwing machine 4.

Figure 2:
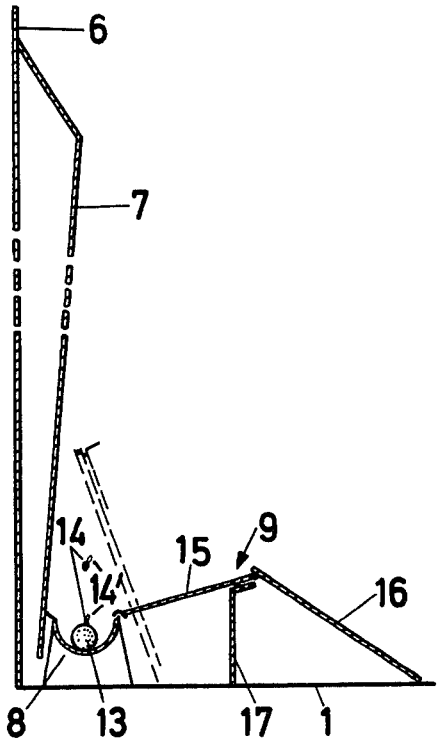
FIG. 2 shows a part of the apparatus in vertical section at right angles to length of the collecting chute.

For this purpose, a rebound-deadening wall 7, at the lower end of which a collecting chute 8 is located, is mounted on the boundary fence 6 of the tennis court. The collecting chute 8 is joined on the court side by a double section ramp 9, which, as shown in FIG. 2, includes a ramp section 15, rising away from the collecting chute 8, and a ramp section 16, adjacent to the latter, which descends towards the court 1. The two ramp sections 15 andd 16 are releasably connected to each other by an articulated joint and possess a series of feet 17. The ramp 9 can thus be turned upwards into the folded maintenance position, indicated by the broken lines in FIG. 2, when the apparatus is not required. The tennis-balls 13 pass along the collecting chute 8, with the aid of an endless conveyor element 14, to a withdrawal point 10 and through a flexible tube 11 to a ball-dispensing unit 12, which can be fixed to the ball-throwing machine 4. In this way, the balls 13, which have been played, can again be conveyed back to the ball-throwing machine 4 and are available for fresh play.

The endless conveyor element 14 is formed by a string such as a cord or the like, passing around two sheave pulleys 20 and possess preferably evenly spaced projections 14', such as knots, buttons or the like. The run of the conveyor element 14 makes contact from above with the tennis balls 13, present in the chute 8, and carries them along under friction.

Figure 4:
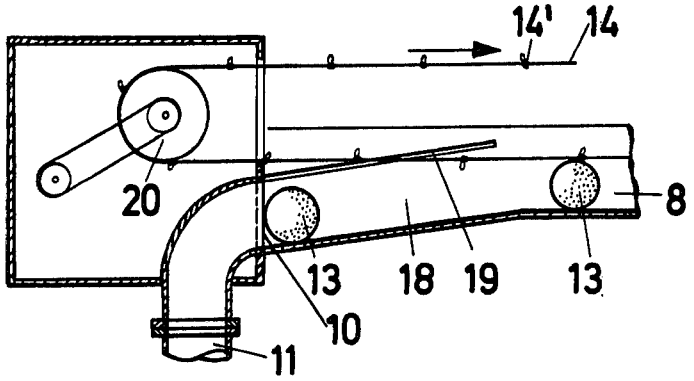

The withdrawal point 10 of the collecting chute 8 is shown in detail in FIG. 4. The collecting chute 8 at this withdrawal point 10 possesses a downwardly sloping section 18, across which the tennis balls 13 pass into the flexible tube 11. Above the downward sloping section 18 of the chute, two guide rods 19 are located, between which the run of the endless conveyor element 14 moves towards the sheave pulley 20. The sheave pulley 20 is driven by means of a diagrammatically indicated drive device, so that the endless conveyor element 14 moves in the direction of the arrow. The projections 14', positioned on the conveyor element at a distance from one another, prevent several tennis balls 13 collecting at the withdrawal point, which would obstruct transport of these balls to the withdrawal point 10.

Figure 3:
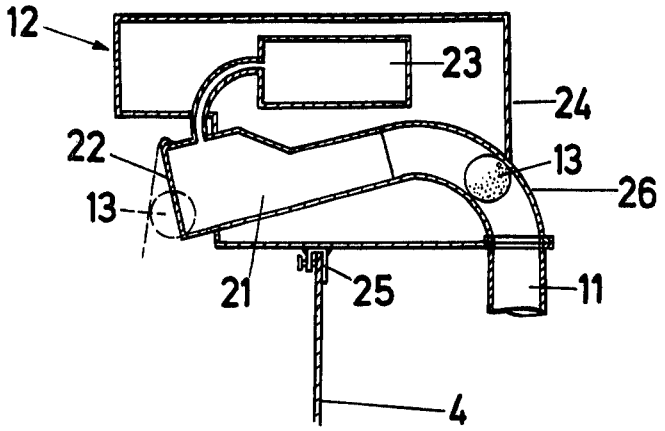
FIG. 3 is a vertical section through the ball dispensing unit, to be fixed to the ball-throwing machine; and, FIG. 4 shows the withdrawal point of the collecting chute in vertical section running parallel to the length of the collecting chute.

The tennis balls 13 pass through the flexible tube 11 to the ball-dispensing unit 12, which is diagrammatically represented in FIG. 3. The unit has a casing 24, which can be fixed to the ball-throwing machine 4 by means of a clamp 25, a device 23 for generating underpressure, which is laterally attached to an end piece 21 of enlarged section of a rigid tubular supply conduit 26 for the tennis balls 13. The end piece 21 is closed at the downstream end by a freely rotatable flap 22. This flap 22 is kept by the underpressure in the closed position. If a tennis ball 13 now passes into the end piece 21 of the conduit 26, it momentarily opens the flap 22 by its impact and can leave from the end piece 21 and drop into the ball-throwing machine 4. Subsequently, the flap 22 again closes automatically. The fact that the end piece 21 of the conduit 26 slopes obliquely downwards and has an enlarged cross section prevents the connection of the supply line to the device 23 for generating underpressure, which is located on the upper side of the end piece 21, being blocked by the aspirated tennis balls.

It can be seen that when the apparatus according to the invention is attached to any ball-throwing machine for providing an automatic training unit for tennis, the site of the ball-throwing machine is without importance. The unit can therefore be attached to stationary as well as movable ball-throwing machines.

I claim:

1. Apparatus for conveying tennis balls to a ball-throwing machine, said apparatus comprising a collecting chute; a rebound-deadening wall projecting upwards from one side of said collecting chute; a flexible tube having first and second ends and attached at said first end to said collecting chute at a withdrawal point thereof; a rigid conduit having first and second ends and attached at said first end thereof to said second end of said flexible tube; a hinged closure at said second end of said rigid conduit; and a device for generating underpressure connected laterally to said rigid conduit, whereby said underpressure in said rigid conduit normally holds said hinged closure in a closed position and tennis balls passing from said collecting chute into said flexible tube are conveyed therealong by said underpressure to said rigid conduit where a ball is capable of opening said hinged closure and thereby passing out of said rigid conduit to said ball-throwing machine; said apparatus being further characterised in that:

(a) said collecting chute is provided with an endless conveyor element passing around two sheaves and provided with spaced ball-entrainment means, a run of said conveyor element being spaced above a bottom of said collecting chute by a distance so as to engage balls in said chute;

(b) said collecting chute has a downwardly sloping section only at one end adjacent to said withdrawal point and is provided above said downwardly sloping section with at least two guide members adapted to deflect said balls downwards, said run of said conveyor element passing between said guide members;

(c) a double section ramp is fitted to the side of said chute remote from said one side from which said rebound-deadening wall projects upwards, a first section of said ramp rising upwards away from said collecting chute and a second section of said ramp descending from said first section in use to the level of a tennis court on which said chute stands; and (d) said flexible tube is freely movable and extends to a ball-dispensing unit incorporating said device for generating underpressure and said rigid conduit and adapted to be fitted to said ball-throwing machine, said device for generating underpressure being attached to the upper wall of an obliquely downwardly sloping end piece of said rigid conduit, said end piece being provided at its lower end with said hinged closure and having a cross section greater than an upstream portion of said rigid conduit.

2. Apparatus according to claim 1, wherein said endless conveyor element is a flexible string and said ball-entrainment means are projections from said string.

3. Apparatus according to claim 2, wherein said projections are knots in said string.

4. Apparatus according to claim 2, wherein said projections are buttons carried on said string.

5. Apparatus according to any one of claims 2 to 4, wherein said ball-entrainment means are evenly spaced along said endless conveyor element.

6. Apparatus according to claim 1 or claim 2, wherein said first ramp section is detachably pivotally connected to said collecting chute and said second ramp section is detachably pivotally connected to said first ramp section.

* * * * *